US011537065B2

(12) United States Patent
Sunahara

(10) Patent No.: US 11,537,065 B2
(45) Date of Patent: Dec. 27, 2022

(54) DEVELOPING UNIT, PROCESS CARTRIDGE, AND IMAGE FORMING APPARATUS USING TONER TO DEVELOP TONER IMAGE

(71) Applicant: CANON KABUSHIKI KAISHA, Tokyo (JP)

(72) Inventor: Satoshi Sunahara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/341,182

(22) Filed: Jun. 7, 2021

(65) Prior Publication Data

US 2021/0389696 A1 Dec. 16, 2021

(30) Foreign Application Priority Data

Jun. 12, 2020 (JP) ..... JP2020-102032

(51) Int. Cl.
*G03G 15/08* (2006.01)
*G03G 15/09* (2006.01)

(52) U.S. Cl.
CPC ..... *G03G 15/0881* (2013.01); *G03G 15/0889* (2013.01); *G03G 15/09* (2013.01); *G03G 15/0921* (2013.01); *G03G 2215/0609* (2013.01); *G03G 2215/0844* (2013.01)

(58) Field of Classification Search
CPC ..... G03G 15/0881; G03G 15/0882; G03G 15/0884; G03G 2215/0877; G03G 2215/088; G03G 2215/0883; G03G 15/0893; G03G 15/0891; G03G 15/0889; G03G 2215/0802; G03G 2215/0844;
(Continued)

(56) References Cited

U.S. PATENT DOCUMENTS 6,308,037 B1 * 10/2001 Yamashita ..... G03G 15/0822 399/272
2011/0033210 A1 * 2/2011 Shinozaki ..... G03G 15/0865 399/272

(Continued)

FOREIGN PATENT DOCUMENTS

JP 2005070364 A 3/2005
JP 2020024309 A 2/2020
JP 2020076867 A 5/2020

*Primary Examiner* — Walter L Lindsay, Jr.
*Assistant Examiner* — Laura Roth
(74) *Attorney, Agent, or Firm* — Canon U.S.A., Inc. IP Division

(57) ABSTRACT

A developing unit includes a conveying member which rotates to convey the developer to the developer bearing member. The conveying member includes a sheet portion with one end fixed to a rotation shaft and a free end which enters the developing chamber through an opening when the conveying member rotates around a rotation center, wherein relations C>A and B>A are satisfied, where A is a distance from the rotation center to an upstream end of the opening in a rotational direction, B is a distance from the rotation center to a downstream end of the opening in the rotational direction, and C is a length from the rotation center to the free end of the sheet portion in an unbent state. The upstream end of the opening is lower in a direction of gravitational force than the downstream end at an orientation in use.

15 Claims, 15 Drawing Sheets

(58) Field of Classification Search
CPC ..... G03G 2215/085; G03G 15/09; G03G 15/0921; G03G 2215/0609
See application file for complete search history.

(56) References Cited

U.S. PATENT DOCUMENTS

| | | | | |
|---|---|---|---|---|
| 2016/0062270 | A1* | 3/2016 | Fukasawa ..... | G03G 15/0889 399/106 |
| 2021/0389693 | A1* | 12/2021 | Kamoshida ..... | G03G 15/0889 |

* cited by examiner

DEVELOPING UNIT, PROCESS CARTRIDGE, AND IMAGE FORMING APPARATUS USING TONER TO DEVELOP TONER IMAGE

BACKGROUND

Field of the Disclosure

The present disclosure generally relates to image forming apparatuses and developing units and cartridges used in the image forming apparatuses. More specifically, this disclosure relates to an electrophotographic image forming apparatus, and a developing unit and a cartridge which are used in an electrophotographic image forming apparatus.

Description of the Related Art

A developing unit (a developing cartridge) that is detachably attached to an image forming apparatus is generally known.

Japanese Patent Laid-Open No. 2005-070364 discloses a developing unit in which the inner space of a developing frame constituting the developing unit is partitioned by a partition having a communication opening into a "developing chamber" and a "toner container". The toner container houses a toner conveying member, and the developing chamber has a developing sleeve. The toner conveying member is used to supply a magnetic toner from the toner container to the developing chamber.

From the viewpoint of improving the life of use of the toner, circulation of the toner between the developing chamber and the toner container is required such that the toner supplied from the toner container to the developing chamber is returned to the toner container and is mixed with the toner in the toner container. Japanese Patent Laid-Open No. 2005-070363 proposes a configuration for facilitating the circulation of the toner between the developing chamber and the toner container by enabling the distal end of a stirring sheet provided in the toner container to enter the developing chamber through a communication opening.

However, as image forming apparatuses and developing units have been reduced in size, a decrease in the diameter of a developing sleeve housing a magnet roller is required, and the magnetic flux density (magnetic force) of the magnet roller may be decreased. This may cause the movement of the developer in the vicinity of the developing sleeve along with the rotating operation of the developing sleeve to be limited to an area close to the surface of the developing sleeve.

As a result, the developer supplied from the toner container to the developing chamber may tend to stagnate in the developing chamber, and the electrostatic property of the developer may be prone to decrease. This may decrease the developability of the developing unit at the latter half of the available period (life)

SUMMARY

The present disclosure provides a developing unit, a process cartridge, and an image forming apparatus in which circulation of a magnetic developer between a developing chamber and a developer chamber containing a developer is improved.

A developing unit according to a first aspect of the present disclosure includes a developing frame, a developer bearing member supported by the developing frame and including a magnetic-field generating member, the developer bearing member being configured to carry a developer having a magnetic property, a conveying member supported by the developing frame and including a rotation shaft and a sheet portion of which a first end is fixed to the rotation shaft and a second end is a free end, the conveying member conveying the developer to the developer bearing member, and a partition that partitions an inner space of the developing frame into a developing chamber in which the developer bearing member is disposed and a developer chamber in which the rotation shaft of the conveying member is disposed, the partition including an opening for communicating the developing chamber with the developer chamber, wherein, when the conveying member rotates, the free end of the sheet portion enters the developing chamber through the opening, wherein relations C>A and B>A are satisfied, where A is a distance from a rotation center of the rotation shaft to an upstream end of the opening in a rotational direction of the rotation shaft, B is a distance from the rotation center to a downstream end of the opening in the rotational direction, and C is a length from the rotation center to the free end of the sheet portion in an unbent state, and wherein the upstream end of the opening is lower in a direction of gravitational force than the downstream end at an orientation in use.

A process cartridge according to a second aspect of the present disclosure includes the developing unit and an image bearing member that carries an image.

An image forming apparatus according to a third aspect of the present disclosure includes the developing unit or the process cartridge and a fixing member.

Further features of the present disclosure will become apparent from the following description of exemplary embodiments with reference to the attached drawings.

DESCRIPTION OF THE EMBODIMENTS

An electrophotographic image forming apparatus (hereinafter sometimes simply referred to as "image forming apparatus") according to embodiments of the present disclosure will be described hereinbelow with reference to the drawings.

It is to be understood that the embodiments described below illustrate the present disclosure by way of example and that the sizes, materials, shapes, and relative positions among the components do not limit the scope of the present disclosure unless otherwise specified.

The electrophotographic image forming apparatus is an apparatus that forms an image on a recording medium using an electrophotographic image forming method. Examples of the electrophotographic image forming apparatus include electrophotographic copying machines, electrophotographic printers (for example, a laser beam printer and a light-emitting diode [LED] printer), facsimile machines, and word processors.

A developing unit used in the image forming apparatus includes at least a developing means. The developing unit may be a cartridge that can be attached and detached to/from the main body of the electrophotographic image forming apparatus. The developing unit may include a toner cartridge that is configured to be attached and detached to/from the frame of the developing unit and to supply toner to the developing unit.

A process cartridge constituting part of the image forming apparatus is a cartridge in which a charging means, a developing means, or a cleaning means and an electrophotographic photosensitive drum are integrated and which is configured to be attached and detached to/from the main body of the electrophotographic image forming apparatus. The process cartridge may be a cartridge in which at least one of a charging unit, a developing unit, and a cleaning unit is integrated with an electrophotographic photosensitive drum and which is configured to be attached and detached to/from the main body of the electrophotographic image forming apparatus. The process cartridge may be a cartridge in which at least a developing unit and an electrophotographic photosensitive drum are integrated and which is configured to be attached and detached to/from the main body of the electrophotographic image forming apparatus. The process cartridge may be fixed to the image forming apparatus for use.

First Embodiment

Referring to FIG. 1A to FIG. 13, an image forming apparatus according to a first embodiment of the present disclosure will be described hereinbelow.

Configuration of Image Forming Apparatus

Figure 2:
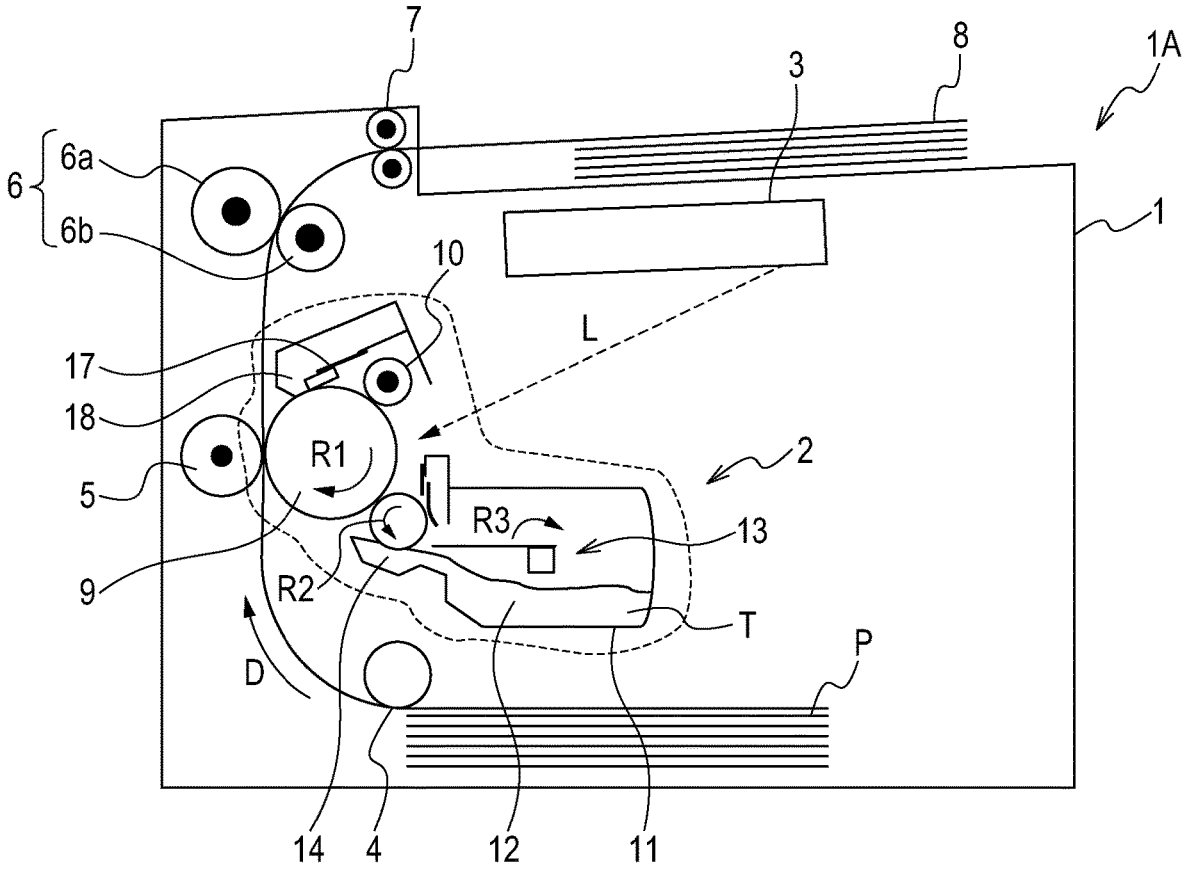
FIG. 2 is a conceptual cross-sectional view of the image forming apparatus according to the first embodiment.

FIG. 2 is a conceptual diagram showing a cross section of the configuration of the image forming apparatus according to the first embodiment.

As shown in FIG. 2, a cartridge 2 including a developing unit 11 is attached to the apparatus main body 1 of an image forming apparatus 1A for use. In the attached state, an exposure unit 3 (a laser scanner unit) is disposed above the cartridge 2. Recording media (hereinafter referred to as "sheet materials P) on which an image is to be formed are housed under the cartridge 2.

The apparatus main body 1 further includes a pickup roller 4, a transfer roller 5, a fixing unit 6, a discharge roller 7, and an output tray 8 in order in the conveying direction D of the sheet material P. The fixing unit 6 includes a heating roller 6*a* and a pressure roller 6*b*.

Image Forming Process

Figure 3:
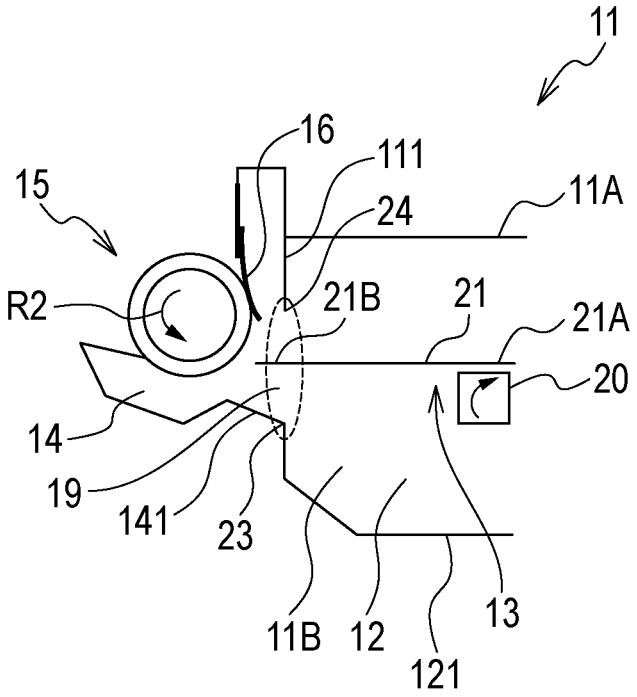
FIG. 3 is a conceptual cross-sectional view of the developing unit according to the first embodiment.

Referring to FIG. 2 and FIG. 3, an image forming process (operation) will next be described.

As shown in FIG. 2, in the image forming apparatus 1A of this embodiment, an electrophotographic photosensitive drum (hereinafter referred to as "drum 9") is rotationally driven in the direction of arrow R1 at a predetermined circumferential speed (a process speed of 200 mm/sec) in response to a print start signal. A charging roller 10 to which a bias voltage is applied is in contact with the outer circumferential surface of the drum 9 to uniformly charge the outer circumferential surface of the drum 9.

The exposure unit 3 outputs laser light L according to the image information. The laser light L scans and exposes the outer circumferential surface of the drum 9 with light. Thus, a static latent image corresponding to the image information is formed on the outer circumferential surface of the drum 9.

In the developing unit 11, a magnetic toner T (a single-component magnetic developer) in a container 12 is stirred and conveyed by the rotation of a conveying member 13 into a developing chamber 14.

The toner T carried on the surface of a developer bearing member 15 (the circumferential surface 15B1 of a sleeve 15B, described later) is regulated in thickness on the circumferential surface of the developer bearing member 15 while being friction-charged by a developing blade 16 (a developer regulating member). The toner T is transferred to the drum 9 (the static latent image) by a developing bias applied to the static latent image and the developer bearing member 15 and is visualized as a toner image.

The sheet material P contained in the lower part of the apparatus main body 1 is fed in accordance with a laser light L output timing. The sheet material P is supplied to a transfer position between the drum 9 and the transfer roller 5. At the transfer position, the toner image is transferred in sequence from the drum 9 to the sheet material P.

The sheet material P to which the toner image is transferred is separated from the drum 9 and is conveyed to the fixing unit 6. The sheet material P passes through a nipping portion between the heating roller 6*a* and the pressure roller 6*b* constituting the fixing unit 6. The sheet material P is pressed and heated at the nipping portion, so that the toner image is fixed to the sheet material P.

The sheet material P to which the toner image is fixed is conveyed to the discharge roller 7 and is discharged onto the output tray 8. For the drum 9 after the transfer, the residual toner on the outer circumferential surface is removed by a cleaning blade 17 and is used for an image forming process again. The toner removed from the drum 9 is stored in a waste toner chamber 18.

Configuration of the Developing Unit

Figure 4:
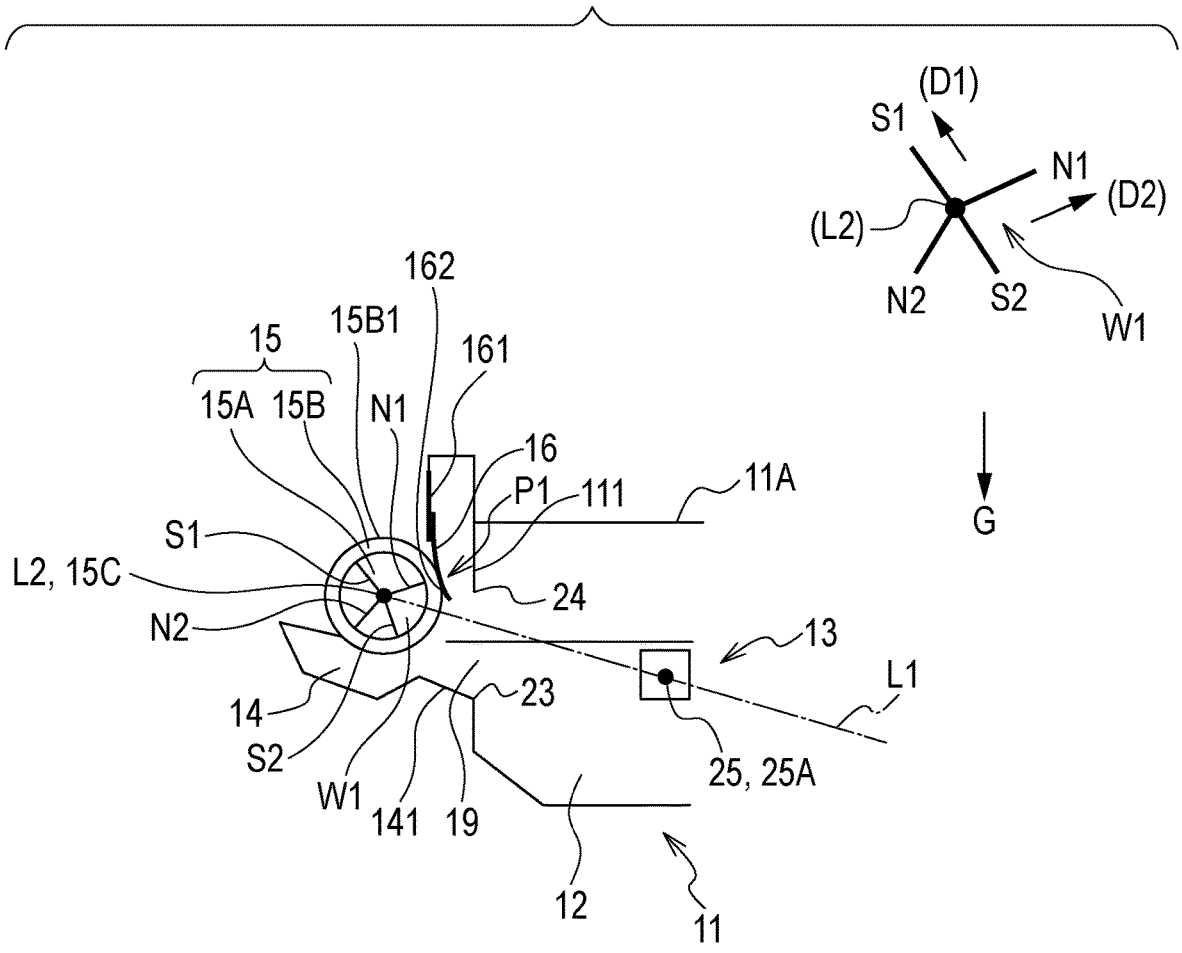
FIG. 4 is a conceptual diagram illustrating the magnetic pole disposition of a magnet roller according to the first embodiment.

Next, the developing unit 11 of this embodiment will be described with reference to FIG. 3 and FIG. 4. FIG. 3 and FIG. 4 are conceptual cross-sectional views of the developing unit 11 according to the first embodiment of the present disclosure.

As shown in FIG. 3 and FIG. 4, the developing unit 11 of this embodiment mainly includes a developing frame 11A, the developer bearing member 15, and the conveying member 13. The developer bearing member 15 is supported by the developing frame 11A. The developer bearing member 15 includes a sleeve 15B and a magnet roller 15A (a magnetic-field generating member) inside the sleeve 15B and is configured to carry the magnetic toner T (one-component magnetic developer).

The conveying member 13 is supported by the developing frame 11A and is configured to convey the developer to the developer bearing member 15. The conveying member 13 includes a rotation shaft 20 extending in an axial direction 25A and a sheet-like member 21 (a sheet portion) of which one end 21A is fixed to the rotation shaft 20 and the other end 21B is a free end.

The developing frame 11A is provided with a partition 111. The partition 111 partitions a space 11B, inside the developing frame 11A, into the developing chamber 14 in which the developer bearing member 15 is housed and the container 12 (developer chamber) in which the conveying member 13 is housed.

The partition 111 includes a developing opening 19 (an opening) that communicates the developing chamber 14 with the container 12. When the conveying member 13 rotates, the free end (the other end 21B) of the sheet-like member 21 can enter the developing chamber 14 through the developing opening 19.

Specifically, as shown in FIG. 3 and FIG. 4, the developing chamber 14 is provided with the developer bearing member 15 that carries the toner T and the developing blade 16 (regulating member) that regulates the toner layer. The developer bearing member 15 includes the sleeve 15B (developing sleeve) having appropriate roughness and made of a material for charging the toner T on the circumferential surface 15B1 of an aluminum pipe with a diameter of 10 mm. Inside the sleeve 15B, the magnet roller 15A with a diameter of 7.8 mm is fixed so as to have a predetermined magnetic pole disposition.

In this embodiment, the developing blade 16 includes a supporting portion made of sheet metal and a contact portion made of resin, such as urethane rubber, with a thickness of 1 mm, supported by the supporting portion. The contact portion is fixed to the developing frame 11A (developing chamber) with the supporting portion. In other words, one end 161 of the developing blade 16 is fixed and the other end 162 is a free end. The other end 162 (free end) is in contact with the circumferential surface 15B1 of the developer bearing member 15 so as to extend upstream in the rotational direction (R2) of the developer bearing member 15. The position of the contact portion (regulating position P1) is disposed above an upstream end 23 of the developing opening 19 in the direction of gravitational force G, at the orientation when used.

In this embodiment, the conveying member 13 is disposed in the container 12 and has the rotation shaft 20 parallel to the developer bearing member 15. The one end 21A of the elastically deformable sheet-like member 21 is fixed to the rotation shaft 20, and the other end 21B is a free end. In this embodiment, the sheet-like member 21 has a longitudinal width 1 mm shorter at opposite ends than the width of the developing opening 19. This allows the free end (the other end 21B) of the sheet-like member 21 to enter the developing chamber 14 through the developing opening 19.

In this embodiment, the distance C (see FIG. 8) from the rotation center 25 to the distal end of the free end of the sheet-like member 21 in an unbent state (the free length of the sheet-like member 21) is 30 mm, and the thickness of the sheet-like member 21 is 188 μm.

In this embodiment, a line L1 connecting the rotation center 15C of the sleeve 15B and the rotation center 25 of the rotation shaft 20 passes through the area of the developing opening 19 when viewed from the axial direction 25A of the rotation shaft 20 (see FIG. 4).

The rotation center 25 of the rotation shaft 20 is disposed above the upstream end 23 of the developing opening 19 and lower than the center 15C of the sleeve 15B (developer bearing member 15) when viewed from the axial direction 25A of the rotation shaft 20 (see FIG. 4).

FIG. 4 is a conceptual diagram illustrating the magnetic pole disposition of the magnet roller 15A of the first embodiment of the present disclosure.

As shown in FIG. 4, the magnet roller 15A of this embodiment has a four magnetic pole configuration. Specifically, the magnet roller 15A has an S1 pole (65 mT) facing the photosensitive drum 9, an N1 pole (55 mT) in the direction in which the developing blade 16 is in contact therewith, an S2 pole (45 mT) in the direction of the developing chamber 14, and an N2 pole (50 mT) for preventing the toner T from blowing out of the developing chamber 14.

In other words, the first magnetic pole (S1) is disposed in a direction (D1) facing the photosensitive drum 9 (the image bearing member) that carries a static latent image in a cross section orthogonal to the longitudinal direction L2 of the developer bearing member 15, as shown in FIG. 4, for example.

The second magnetic pole (N1) is disposed in a direction (D2) facing the regulating position (P1).

The third magnetic pole (N2) is positioned next to the first magnetic pole (S1) and opposite to the second magnetic pole (N1).

The fourth magnetic pole (S2) is positioned next to the second magnetic pole (N1) and opposite to the first magnetic pole (S1).

Even if the sleeve 15B rotates, the magnetic poles are each kept in a fixed direction because the magnet roller 15A itself is fixed without being rotated.

Figure 5:
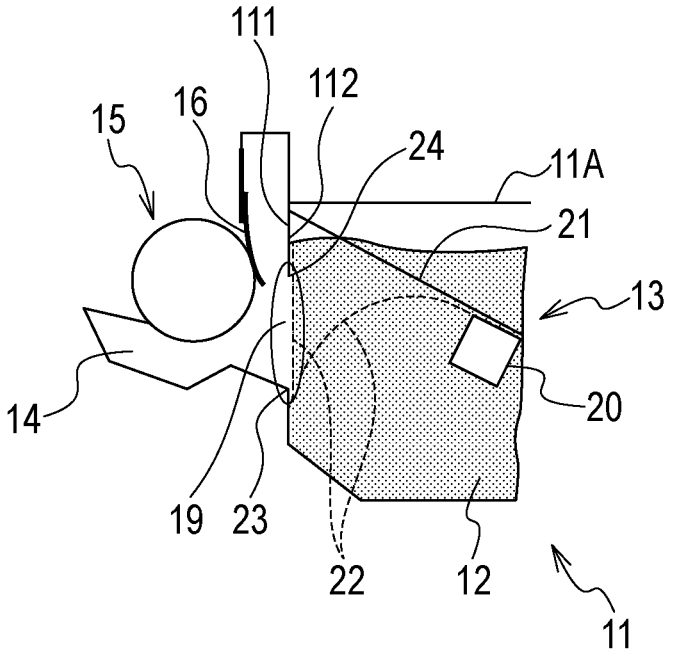
FIG. 5 is a conceptual diagram of the developing unit according to the first embodiment in an unused state.

FIG. 5 is a conceptual diagram of the developing unit 11 according to the first embodiment of the present disclosure in an unused state. Specifically, FIG. 5 illustrates the state of the developing unit 11 before being used.

As shown in FIG. 5, a sealing member 22 is attached to the wall (the partition 111) of the container 12 so as to close the developing opening 19, so that the toner T in the container 12 does not move to the developing chamber 14 before the developing unit 11 is used.

The sealing member 22 is a sheet-like member including a portion (one end) attached to an attaching surface 112 of the partition 111 and a portion (the other end) fixed to the rotation shaft 20 of the conveying member 13 so as to close the developing opening 19. In this embodiment, the distance from the rotation center 25 of the conveying member 13 to the distal end (the free end) of the sealing member 22 in the unbent state is 80 mm, and the thickness of the sealing member 22 is 50 μm.

Figure 6:
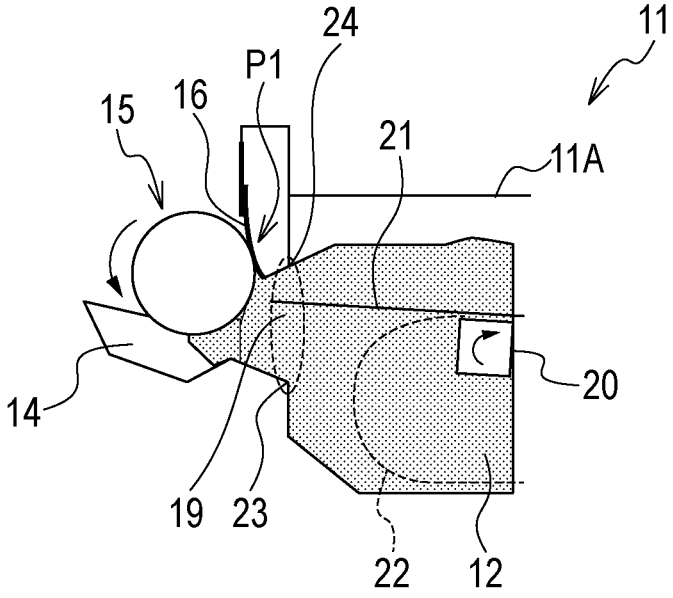
FIG. 6 is a conceptual diagram of the developing unit according to the first embodiment after the start of use.

FIG. 6 is a conceptual diagram illustrating the developing unit 11 according to the first embodiment of the present disclosure after the start of use. Specifically, FIG. 6 illustrates a state in which the sealing of the developing opening 19 of the developing unit 11 (with the sealing member 22) is released, so that the developing opening 19 is opened.

As shown in FIG. 6, in this embodiment, when driving from the apparatus main body 1 is transmitted at the start of an image forming operation, the rotation shaft 20 of the conveying member 13 is rotated. As the rotation shaft 20 rotates, the sealing member 22 that seals the developing opening 19 is released, and the container 12 and the developing chamber 14 communicate through the developing opening 19, enabling the toner T to be fed from the container 12 into the developing chamber 14.

In this embodiment, the radius of rotation (the free length) of the sealing member 22 is 80 mm, and the radius of rotation of the conveying member 13 (the free length of the sheet-like member 21) is 30 mm. The sheet thickness of the sealing member 22 is 50 μm, and the sheet thickness of the conveying member 13 is 188 μm. With this configuration, the sheet (sealing member 22) with a thickness of 50 μm is bent by the powder pressure of the toner T and is positioned at the back of the sheet (sheet-like member 21) with a thickness of 188 μm (upstream) in the rotational direction (R3). In other words, the toner T is substantially conveyed by the sheet-like member 21 of the conveying member 13 positioned forward (downstream) in the rotational direction and having a larger thickness.

Figure 1A:
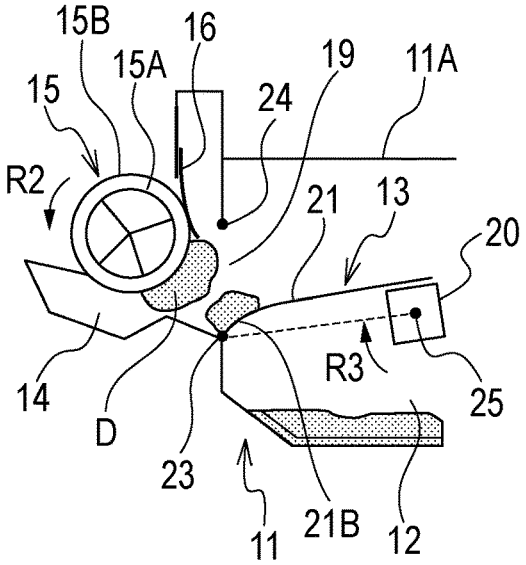
FIGS. 1A to 1C are conceptual diagrams illustrating how toner is conveyed in a developing unit used in an image forming apparatus according to a first embodiment of the present disclosure.
Figure 1B:
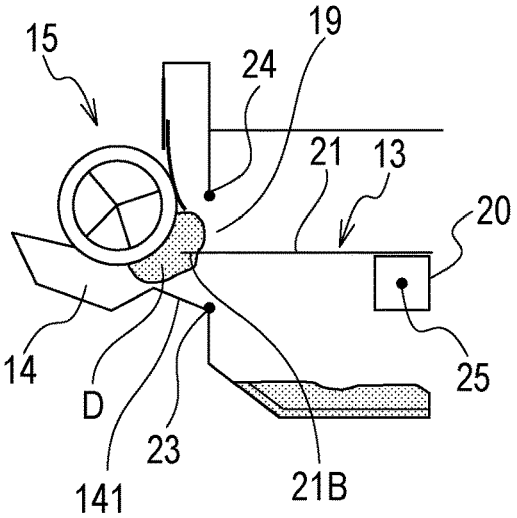
Figure 1C:
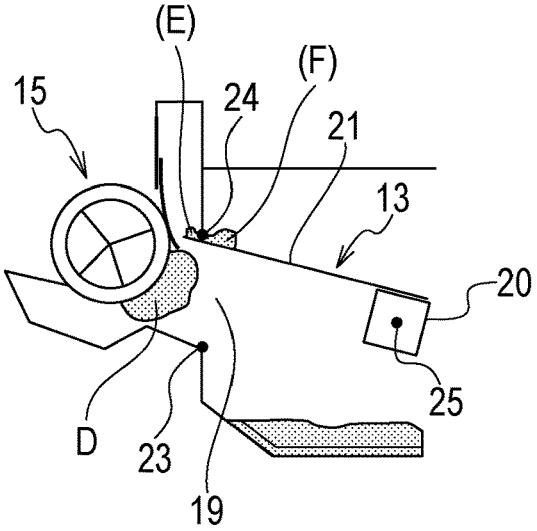

Referring next to FIGS. 1A to 1C, supply (conveyance) of the toner T will be described. FIGS. 1A to 1C are conceptual diagrams illustrating how the toner T is conveyed in the developing unit 11 used in the image forming apparatus 14 according to the first embodiment of the present disclosure.

As shown in FIG. 1A, the seal of the developing opening 19 with the sealing member 22 is released to start usage, the toner T can be fed from the container 12 to the developing chamber 14 through the developing opening 19.

Specifically, the developing opening 19 includes an opening lower end 23 positioned at the lower position and an opening upper end 24 positioned at an upper position. To feed the toner T in the container 12 into the developing chamber 14 through the developing opening 19, it is necessary for the conveying member 13 to raise the toner T to the opening lower end 23 of the developing opening 19 and to feed the toner T into the developing chamber 14.

Since the distal end (the other end 21B) of the sheet-like member 21 of the conveying member 13 is bent (elastically deformed) immediately before passing through the opening lower end 23, the developer is carried on the downstream surface of the bent sheet in the rotational direction (R3).

Referring next to FIG. 1B, when the distal end (the other end 21B) of the sheet-like member 21 passes through the opening lower end 23, the (elastic) deformation of the distal end is reduced (cancelled). At that time, the toner T carried on the surface of the sheet-like member 21 is expelled toward the developer bearing member 15 in the developing chamber 14. The free end (the other end 21B) of the sheet-like member 21 enters the developing chamber 14, with the elastic deformation cancelled.

As shown in FIG. 1C, after passing through the opening upper end 24, the sheet-like member 21 returns to the container 12.

As the conveying member 13 rotates, the sequence of operations shown in FIGS. 1A to 1C is repeated, and the toner T is supplied (conveyed) from the container 12 to the developing chamber 14.

In this embodiment, the conveying member 13 can pass through an area W1 (see FIG. 4) between the second magnetic pole (N1) and the fourth magnetic pole (S2) in the vicinity of the surface of the developer bearing member 15 when rotated.

In other words, since the fourth magnetic pole (S2) is disposed so as to face the developing opening 19, a toner puddle D, described later, tends to be formed in the vicinity of the second magnetic pole (N1). This makes it easy for the free end of the conveying member 13 to come into contact (interfere) with the toner puddle D when passing through the area W1 (between the fourth magnetic pole S2 and the second magnetic pole N1). This therefore makes it easy to bring back the toner T in the toner puddle D from the developing chamber 14 to the container 12.

As shown in FIGS. 1A to 1C, the opening lower end 23 is positioned upstream in the rotational direction (R3) of the conveying member 13, and the opening upper end 24 is positioned downstream. In other words, the opening lower end 23 is the "upstream end" of the developing opening 19, and the opening upper end 24 is the "downstream end". Hereinafter, the opening lower end 23 and the opening upper end 24 are sometimes simply referred to as "(upstream) lower end 23" and "(downstream) upper end 24", respectively.

Figure 7:
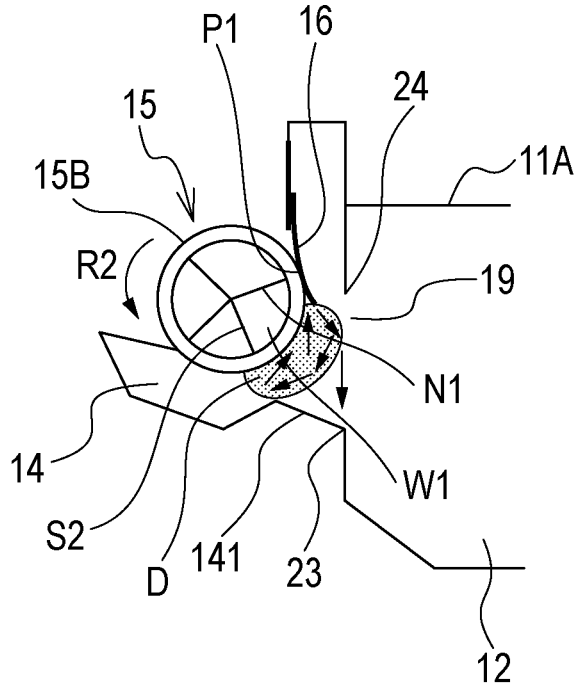
FIG. 7 is a conceptual diagram illustrating the state of a toner puddle in the vicinity of the magnet roller according to the first embodiment.

Referring next to FIG. 7, for the developing unit 11 that uses the magnetic toner T, the motion of the magnetic toner T in the developing chamber 14 along with the rotation (in the rotational direction R2) of the sleeve 15B constituting the developer bearing member 15 will be described. FIG. 7 is a conceptual diagram illustrating the state of the toner puddle D in the vicinity of the circumferential surface of the magnet roller 15B according to the first embodiment of the present disclosure.

In discussing the motion of the magnetic toner T, the toner T is attached only to the developer bearing member 15 so that the toner T is present only in the developing chamber 14 and no toner is present in the container 12, as shown in FIG. 7.

The toner T carried at the S2 pole of the magnet roller 15A in the developing chamber 14 is carried on the surface of the sleeve 15B, and is conveyed to a portion (the regulating position P1) in contact with the developer regulating member 16 along with the rotation of the sleeve 15B. The toner T is regulated by the developer regulating member 16 to form a desired toner coat layer (with a desired thickness and charge distribution) on the sleeve 15B and is conveyed to a developing area in which the photosensitive drum 9 and the sleeve 15B face each other.

In contrast, the toner T that has not passed through the regulating position P1 drops to the lower portion of the developing chamber 14 to reach the vicinity of the developing opening 19 and may be taken at the S2 pole. A toner puddle D is formed in the vicinity of the surface of the sleeve 15B in the area W1 from the S2 pole to the N1 pole (the regulating member). When the magnetic flux density of the magnetic poles of the magnet roller 15B increases, the amount of toner T held by the magnet roller 15B also increases, and the toner puddle D tends to develop.

Advantageous Effects of the Configuration of this Embodiment

The advantageous effects of the configuration of this embodiment will be described in comparison with comparative examples.

Specifically, this embodiment will be described in comparison with Comparative Example 1 and Comparative Example 2 for the feeding of toner from the container to the developing chamber, the motion of the toner in the developing chamber, and the feeding of the toner back from the developing chamber.

Figure 8:
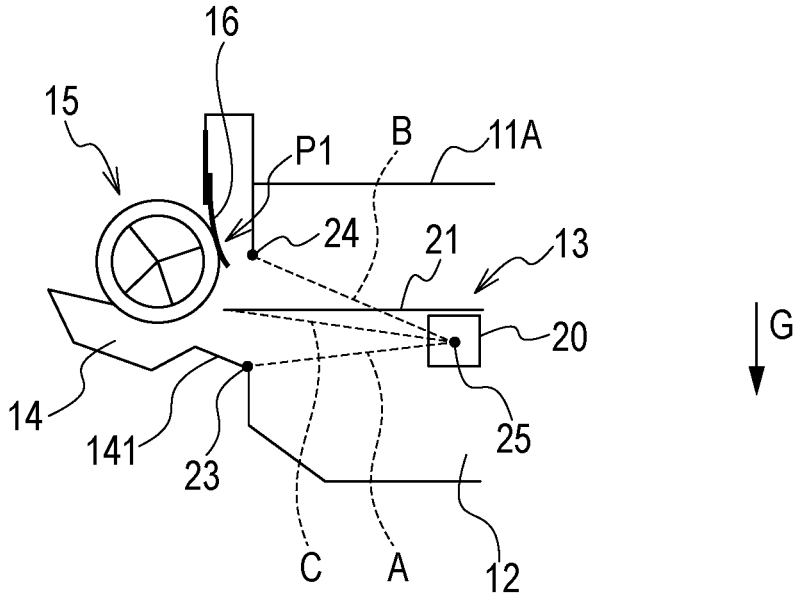
FIG. 8 is a conceptual diagram illustrating the positional relationship between a developing opening and the distal end of a stirring sheet in the developing unit according to the first embodiment.

FIG. 8 is a conceptual diagram illustrating the positional relationship between the developing opening and the distal end of the stirring sheet in the developing unit 11 according to the first embodiment of the present disclosure.

Figure 9:
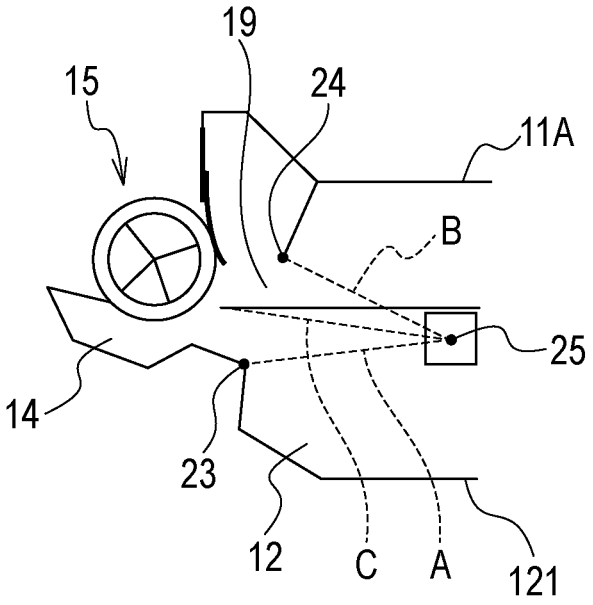
FIG. 9 is a conceptual diagram illustrating the positional relationship between the developing opening and the distal end of the stirring sheet in Comparative Example 1 of the first embodiment.

FIG. 9 is a conceptual diagram illustrating the positional relationship between the developing opening and the distal end of the stirring sheet in Comparative Example 1 of the first embodiment.

Figure 10:
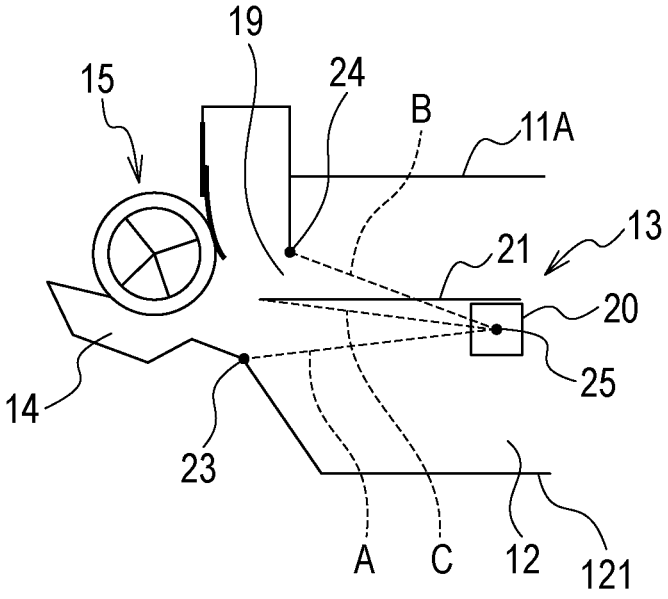
FIG. 10 is a conceptual diagram illustrating the positional relationship between the developing opening and the distal end of the stirring sheet in Comparative Example 2 of the first embodiment.

FIG. 10 is a conceptual diagram illustrating the positional relationship between the developing opening and the distal end of the stirring sheet in Comparative Example 2 of the first embodiment.

Table 1 shows the distance A between the developing opening upstream end (lower end) 23 and the rotation center 25 of the conveying member 13, the distance B between the developing opening downstream end (upper end) 24 and the rotation center 25 of the conveying member 13, and the rotatable distance C of the conveying member 13 (the free length of the sheet-like member 21) in FIG. 8 to FIG. 10.

TABLE 1

| | A | B | C | Distance Relationship |
|---|---|---|---|---|
| First Embodiment | 25 | 28 | 30 | A < B < C |
| Comparative Example 1 | 25 | 20 | 30 | B < A < C |
| Comparative Example 2 | 35 | 28 | 30 | B < C < A |

Comparative Example 1 is an example in which the distance relationship between A and B is reversed from that of the first embodiment, and Comparative Example 2 is an example in which the distance relationship between A and C is reversed from that of the first embodiment.

More specifically, in Comparative Example 1 compared with this embodiment, the opening downstream end (upper end) 24 is closer to the rotation center 25 of the conveying member 13, and in Comparative Example 2, the opening upstream end (lower end) 23 is further away from the rotation center 25 of the conveying member 13.

In the state where the developing unit 11 is in use, the developer regulating member 16 is positioned above the developing opening upstream end (lower end) 23 and the developing opening upstream end (lower end) 23 of the developing opening 19 is disposed above the bottom (the lowermost surface 121) of the container 12.

The following description is on the precondition that the amount (level) of toner in the container 12 is sufficiently small (low). However, even if the amount of toner in the container increases, the same advantageous effects are obtained.

First, conveyance of toner in the first embodiment of the present disclosure will be described in detail with reference to FIGS. 1A to 1C.

As shown in FIG. 1A, the sheet-like member 21 of the conveying member 13 is bent and deformed immediately before the distal end (the other end 21B) of the conveying member 13 reaches the opening upstream end (lower end) 23, and the toner in the container 12 is carried (pressed) on the surface of the sheet-like member 21 forward in the rotational direction.

When the distal end of the conveying member 13 passes through the opening upstream end (lower end) 23, the deformation of the sheet-like member in contact with the wall of the container is cancelled, as shown in FIG. 1B, and the toner is pushed in the direction of the S2 pole of the developing chamber 14 using the cancellation of the deformation (the restoring force).

The pushed toner interferes with the toner puddle D in the vicinity of the sleeve 15B, described above. At that time, the sheet-like member 21 of the conveying member 13 rushes into (interferes with) the toner puddle D at an angle smaller than the angle of repose of the toner with respect to the horizontal plane, allowing part of the toner in the vicinity of the sleeve 15B to be scraped and carried on the sheet-like member 21.

A connection surface (a first surface) 141 connecting to the developing opening upstream end (lower end) 23 in the developing chamber 14 is disposed so as to be less than a predetermined distance away from the toner puddle D, as shown in FIG. 1B. This is because taking a longer distance from the toner puddle D may increase the possibility that the toner fed to the developing chamber 14 by the conveying member 13 is supplied to below the toner puddle D. In other words, the toner is fed to an area where the influence of the magnetic field of the magnet roller 15A is small, and the fed toner is less prone to move in the developing chamber 14, increasing the possibility that the toner is not used for development.

The connection surface 141 is inclined downward from the vicinity of the toner puddle D toward the opening upstream end (lower end) 23 in use. This is because the toner T is fed toward the developing chamber 14 with great force by the cancellation of the deflection of the conveying member 13 immediately after the conveying member 13 passes through the opening upstream end (lower end) 23, and at that time, the magnetic force of the magnet roller 15A inside the sleeve 15B can be efficiently received with a decreasing distance to the sleeve 15B. For this reason, the connection surface 141 may be disposed closer to the sleeve 15B with an increasing distance from the opening upstream end (lower end) 23.

When the distal end of the sheet-like member 21 reaches the opening downstream end (upper end) 24 while carrying the toner, as shown in FIG. 1C, part E of the toner carried on the distal end of the sheet-like member 21 is scraped by the opening downstream end ("upper end") 24 because the distance B between the opening downstream end (upper end) 24 and the rotation center 25 is smaller than the radius of rotation (free length) C of the sheet-like member 21 (see FIG. 8). Part F of the toner carried on a portion slightly shifted from the distal end to the fixed end passes through the opening downstream end (upper end) 24 and returns to the container 12.

The first embodiment allows the toner to be returned (circulated) from the developing chamber 14 to the container 12 while supplying the toner from the container 12 to the developing chamber 14, as shown in FIGS. 1A to 1C.

Figure 11A:
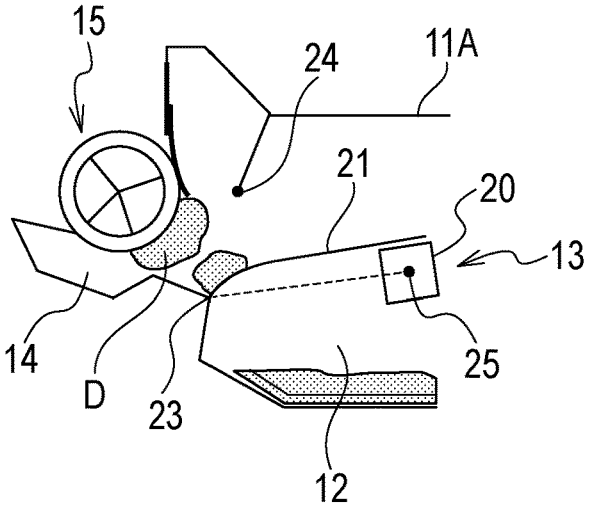
FIGS. 11A to 11C are conceptual diagrams illustrating how the toner in the developing unit is conveyed in Comparative Example 1 of the first embodiment.
Figure 11B:
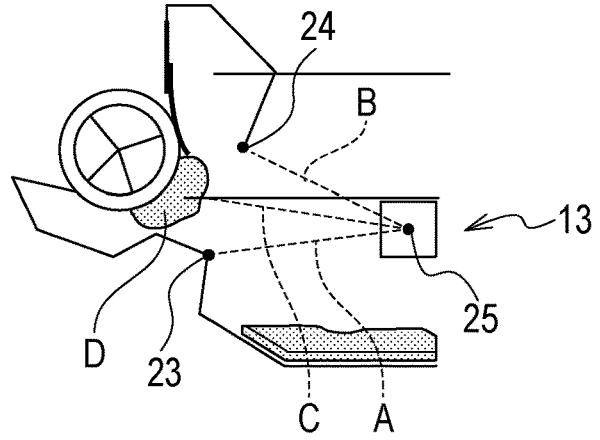
Figure 11C:
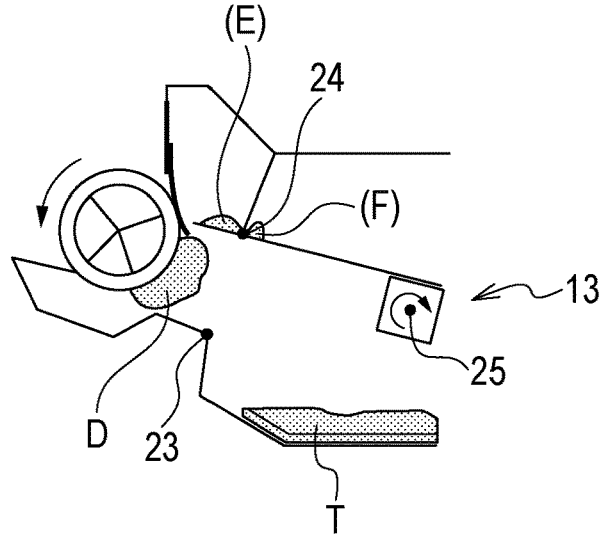

FIGS. 11A to 11C are conceptual diagrams illustrating how the toner in the developing unit 11 is conveyed in Comparative Example 1 of the first embodiment.

The feeding of the toner shown in FIG. 11A and the interference between the toner puddle D and the conveying member 13 shown in FIG. 11B exhibit basically the same behavior as that of the first embodiment (shown in FIGS. 1A and 1B).

A behavior different from that of the first embodiment will next be described. FIG. 11C illustrates how the conveying member 13 passes through the developing opening downstream end (upper end) 24 in Comparative Example 1.

The portion of the distal end of the sheet-like member 21 that enters the developing chamber 14 when the distal end reaches the opening downstream end (upper end) 24 is larger than that in FIG. 1C (the first embodiment). This increases part E (the amount) of the toner carried at the distal end of the sheet-like member 21 and decreases part F (the amount) of the toner carried at the portion shifted a little from the distal end to the fixed end.

In other words, the first embodiment returns the toner more than Comparative Example 1 from the developing chamber to the container.

Next, Comparative Example 2 will be described.

Figure 12:
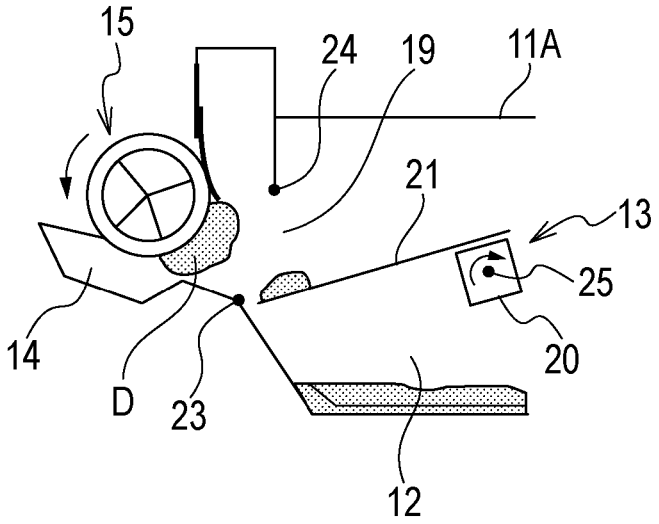
FIG. 12 is a conceptual diagram illustrating how the toner is conveyed in the developing unit in Comparative Example 2 of the first embodiment.

FIG. 12 is a conceptual diagram illustrating how the toner is conveyed in the developing unit 11 in Comparative Example 2 of the first embodiment.

In Comparative Example 2, unlike this embodiment and Comparative Example 1, the bending of the sheet-like member 21 has already been cancelled when the conveying member 13 reaches the developing opening upstream end (lower end) 23. In other words, it is difficult to convey (supply) the toner to the developing chamber 14 using the cancellation (the restoring force) of the bending.

The developing units of the first embodiment and Comparative Examples 1 and 2 are mounted to the same image forming apparatus main body, and print tests were performed.

A 3-dot 200-space lateral stripe pattern was normally printed, and a full solid black image was printed every 1,000 sheets on 5,000 sheets of A4-size plain paper under a normal environment controlled at a room temperature of 23° and a humidity of 50%, and the state of the print was evaluated.

Figure 13:
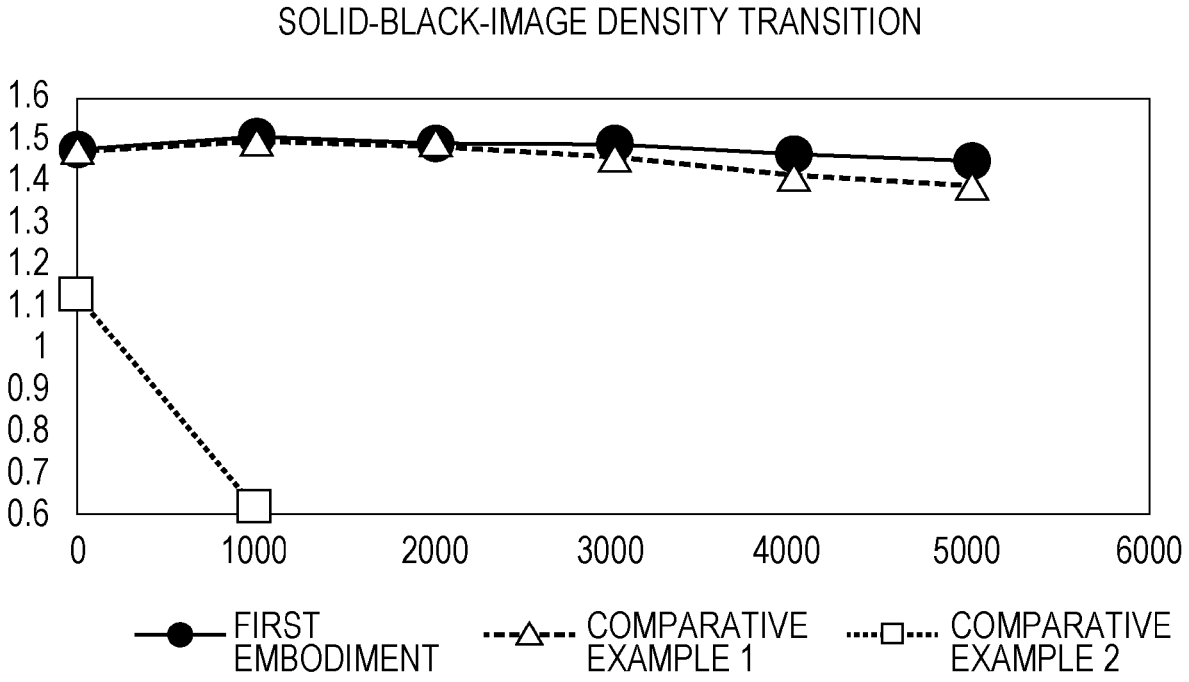
FIG. 13 is a graph showing the results of print tests with the configurations of the first embodiment of the present disclosure and Comparative Example 1 and Comparative Example 2.

First, the density transitions of this embodiment and Comparative Examples 1 and 2 were compared as shown in FIG. 13. FIG. 13 is a graph showing the results of print tests with the configurations of the first embodiment of the present disclosure and Comparative Example 1 and Comparative Example 2.

Specifically, the densities at three points at the distal end in the longitudinal direction, three points at the center in the longitudinal direction, and three points at the trailing end in the longitudinal direction, nine points in total, were measured using an X-Rite 504 spectrodensitometer, and the measurements were averaged as the density of each solid black image, and the transition in density was recorded.

As can be understood from FIG. 13, in this embodiment, the density transition was stable from the beginning until printing of 5,000 sheets. In contrast, in Comparative Example 1, the density changed substantially equally to that of this embodiment until printing of about 3,000, but decreased after printing of 4,000 as compared with this embodiment. In Comparative Example 2, the density decreased from the beginning.

The reason why Comparative Example 1 is inferior to this embodiment may be because of a difference in the amount of toner carried back to the container 12 by the conveying member 13, guessing from the fact that the influence appeared in the latter half of the endurance evaluation.

Based on the above, the parameter (C-A) needs to be increased in the viewpoint of feeding the toner into the developing chamber 14, and the parameter (C-B) needs to be decreased in the viewpoint of feeding back the toner, where (C-A) is the amount of bending, and (C-B) is the amount of interference at the developing opening downstream end (upper end) 24.

In other words, a configuration that satisfies C-A-C-B is needed, and therefore a configuration that satisfies B-A is needed.

In other words, this embodiment satisfies the relation C>A and B>A, where A is the distance from the rotation center 25 of the rotation shaft 20 to the upstream end 23 of the developing opening 19 in the rotational direction R3 of the rotation shaft 20, B is the distance from the rotation center 25 to the downstream end 24 of the developing opening 19 in the rotational direction R3, and C is the length from the rotation center 25 to the free end of the sheet-like member 21 in an unbent state. At the orientation in use, the upstream end 23 of the developing opening 19 was positioned lower than the downstream end 24 in the direction of gravitational force G.

In contrast, for Comparative Example 2, the restoring force from the deformation of the sheet-like member 21 was insufficient. This caused the toner not to be fed well from the container 12, resulting in insufficient supply to the developing chamber 14. As a result, a phenomenon in which missing parts of the image appeared not only in the solid black but also in the lateral stripe pattern during sampling. In other words, the configuration in which the bottom of the container 12, close to the developing opening 19, is lower than the developing opening upstream end (lower end) 23 is required to maintain the relation C>A while the sheet-like member 21 passes through the developing opening upstream end (lower end) 23.

Thus, it is important to satisfy the relation C>A and B>A, which is the configuration of this embodiment, to improve the supply and circulation of the toner.

Second Embodiment

A second embodiment of the present disclosure will be described with reference to FIG. 14 to FIG. 16.

Figure 14:
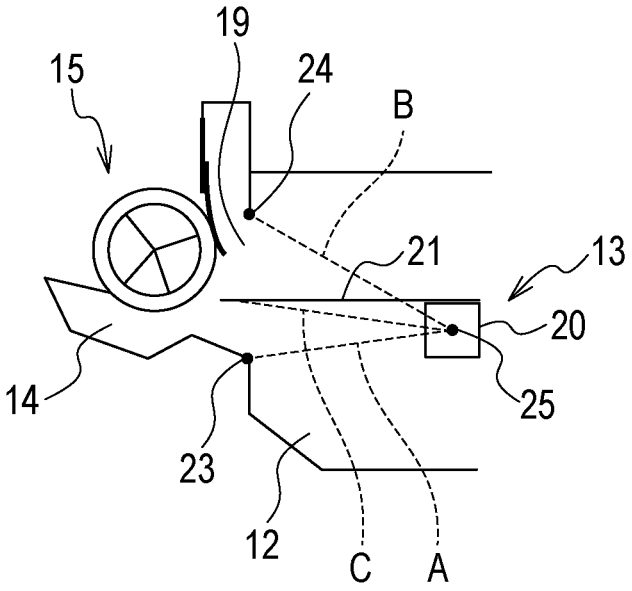
FIG. 14 is a conceptual diagram illustrating the positional relationship between a developing opening and the distal end of a stirring sheet of a developing unit used in an image forming apparatus according to the second embodiment of the present disclosure.

FIG. 14 is a conceptual diagram illustrating the positional relationship between a developing opening and the distal end of a stirring sheet of a developing unit used in an image forming apparatus according to the second embodiment of the present disclosure.

Figure 15A:
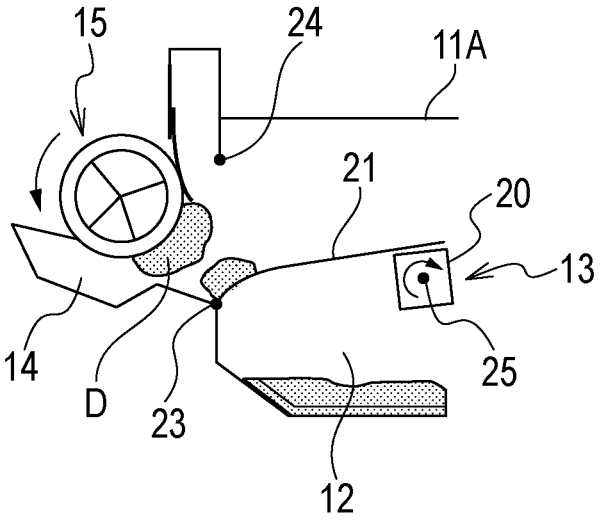
FIGS. 15A to 15C are conceptual diagrams illustrating how the toner is conveyed in the developing unit according to the second embodiment.
Figure 15B:
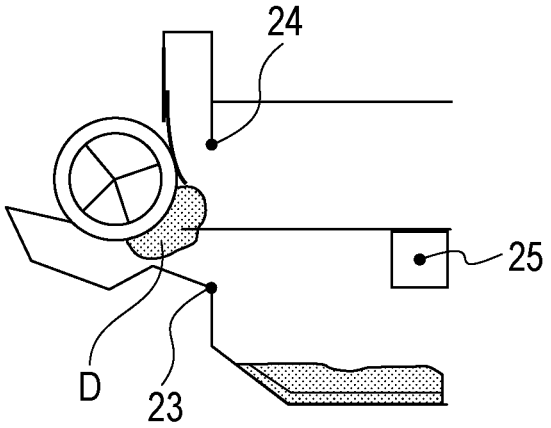
Figure 15C:
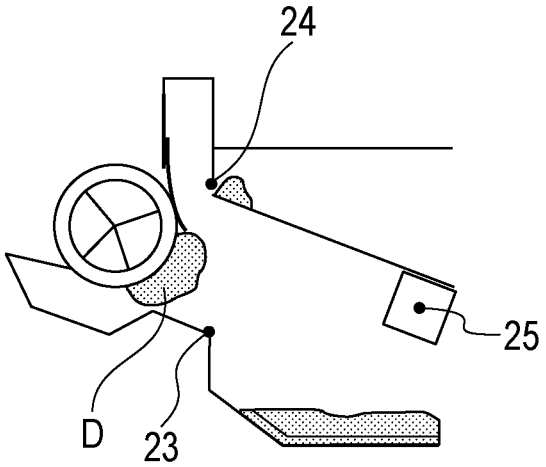

FIGS. 15A to 15C are conceptual diagrams illustrating how the toner is conveyed in the developing unit according to the second embodiment of the present disclosure.

The first embodiment is configured such that the developing opening downstream end (upper end) 24 and the distal end of the sheet-like member 21 of the conveying member 13 slightly interfere (come into contact) with each other. In contrast, the second embodiment is configured such that the developing opening downstream end (upper end) 24 does not interfere (come into contact) with the conveying member 13, as shown in FIG. 14 and FIGS. 15A to 15C.

In other words, the main difference of the second embodiment from the first embodiment is that the conveying member 13 does not come into contact with the opening downstream end (upper end) 24 when passing through the opening downstream end (upper end) 24.

Specifically, the result of comparison (difference in configuration) between the second embodiment and the first embodiment is shown in Table 2.

TABLE 2

| | A | B | C | Distance Relationship |
|---|---|---|---|---|
| First Embodiment | 25 | 28 | 30 | A < B < C |
| Second Embodiment | 25 | 32 | 30 | A < C < B |

The feeding shown in FIG. 15A and the interference with the toner puddle D shown in FIG. 15B are basically the same as those of the first embodiment (FIGS. 1A and 1B).

As shown in FIG. 15C, in the second embodiment, the toner on the sheet-like member 21 is not scraped by the opening upper end 24 when passing through the opening downstream end (upper end) 24. In other words, the toner can return to the container 12 without interference of the opening downstream end (upper end) 24.

Figure 16:
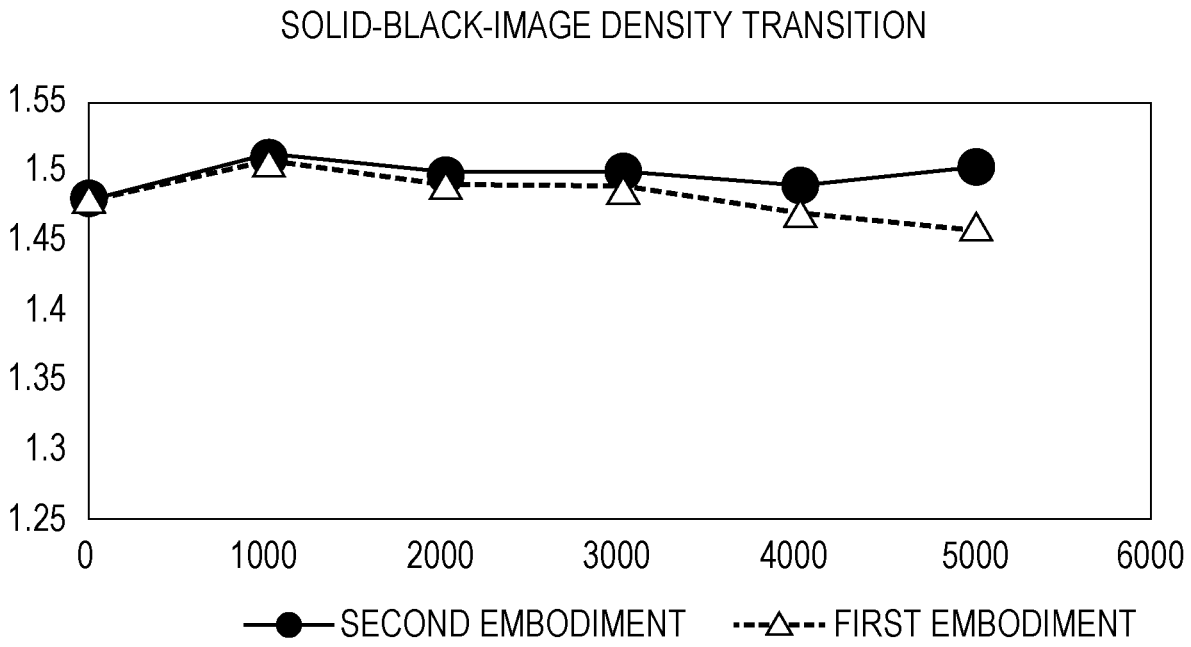
FIG. 16 is a graph showing the result of a print test with the configuration of the second embodiment.

FIG. 16 is a graph showing the result of a print test with the configuration of the second embodiment of the present disclosure.

As shown in FIG. 16, an endurance test was performed on 5,000 sheets of paper, as in the first embodiment, and the density transition of a solid black image was compared with that of the first embodiment.

With the configuration of the second embodiment, the decrease in density in the latter half was more suppressed, and endurance transition was more stable than that in the first embodiment. In other words, the configuration of the second embodiment offers the effect of returning the toner puddle D in the developing chamber 14 to the container 12 more reliably.

Third Embodiment

A third embodiment of the present disclosure will be described with reference to FIGS. 17A and 17B to FIG. 19.

The third embodiment uses a developer bearing member with a larger diameter and a magnet roller with a larger diameter than those of the first and second embodiments.

Figure 17A:
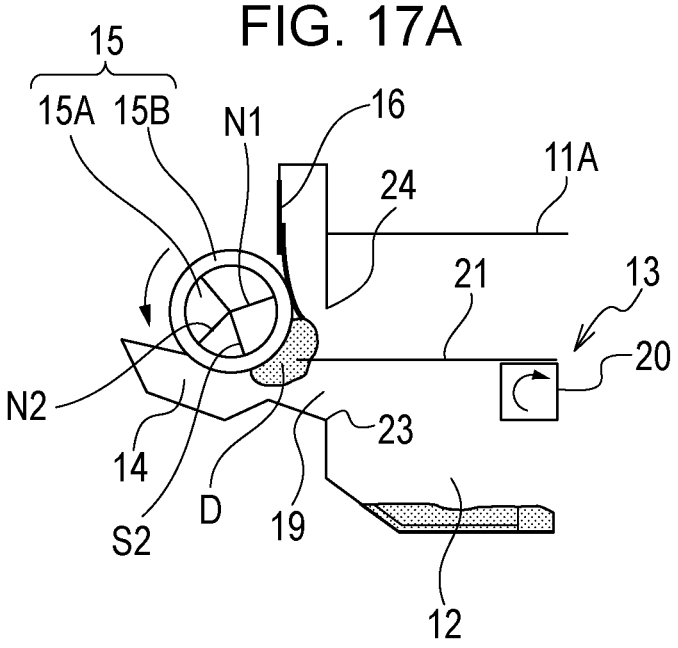
FIGS. 17A and 17B are conceptual diagrams illustrating how the toner is conveyed in the developing unit according to a third embodiment of the present disclosure.
Figure 17B:
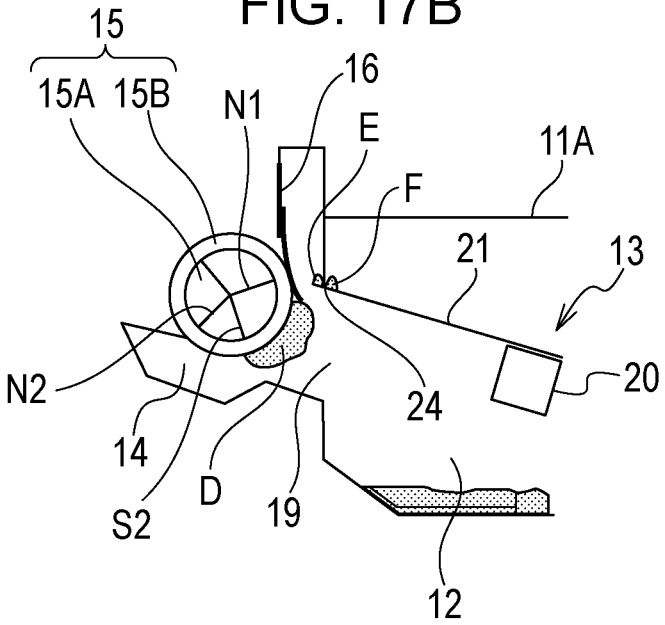

FIGS. 17A and 17B are conceptual diagrams how the toner is conveyed in the developing unit 11 according to the third embodiment of the present disclosure.

The size of the toner puddle D depends not on the size of the magnet roller 15A but on the magnetic flux density of the magnetic poles, as described above. If the toner puddle D is small, a small amount of toner moves repeatedly in the small puddle D and is easy to reach the vicinity of the sleeve 15B, increasing the occasion for charging by friction with the surface of the sleeve 15B. This allows the charge amount of toner in the developing chamber 14 to be increased quickly.

More specifically, the first embodiment uses the sleeve 15B with a diameter of 10 mm, while the third embodiment uses a sleeve 15B with a diameter of 14 mm. The third embodiment uses a magnet roller 15A with the same pole configuration as that of the first embodiment. In other words, the third embodiment uses a magnet roller 15A that has an S1 pole (65 mT), an N1 pole (55 mT) in the direction in which the developing blade 16 is in contact therewith, an S2 pole (45 mT) in the direction of the developing chamber 14, and an N2 pole (50 mT) at which the toner on the developer bearing member 15 returns to the developing chamber 14. In the third embodiment, the diameter of the magnet roller 15A is 11.8 mm.

Figure 18A:
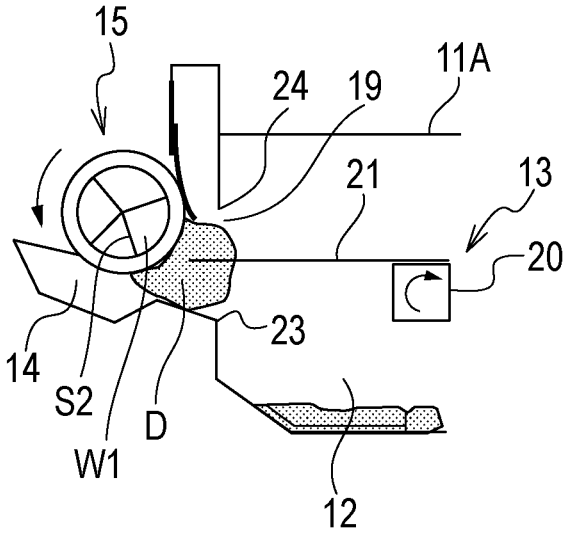
FIGS. 18A and 18B are conceptual diagrams illustrating how the toner is conveyed in the developing unit in Comparative Example of the third embodiment.
Figure 18B:
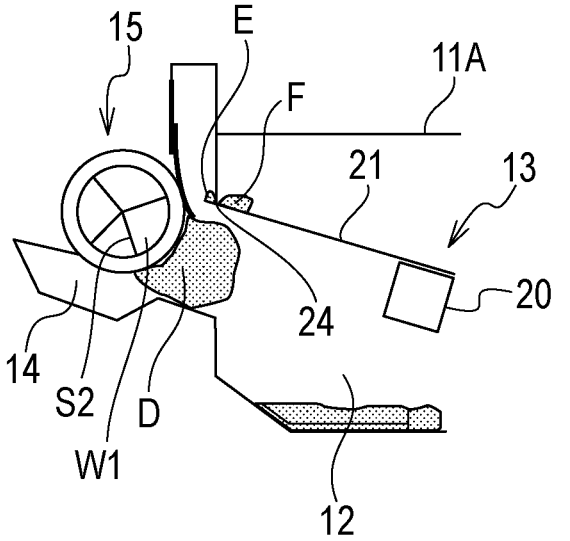

FIGS. 18A and 18B are conceptual diagrams illustrating how the toner is conveyed in the developing unit 11 in Comparative Example of the third embodiment.

In Comparative Example, the magnetic flux density of the S2 pole of the magnet roller 15A constituting the area W1 is 65 mT. The other configuration is basically the same as that of the third embodiment.

The advantageous effects of the third embodiment will be described with reference to Table 3 in contrast with Comparative Example.

As Table 3 shows, the values of A, B, and C are the same in the third embodiment and Comparative Example. The magnetic flux density of the S2 pole that significantly influences the size of the toner puddle D is smaller in the third embodiment than in Comparative Example.

TABLE 3

| | A | B | C | Magnetic Flux Density at S2 Pole (mT) |
|---|---|---|---|---|
| Third Embodiment | 30 | 33 | 35 | 45 |
| Comparative Example | 30 | 33 | 35 | 65 |

FIG. 17A illustrates how the conveying member 13 passes through the toner puddle D in the third embodiment. FIG. 17B illustrates a state after the conveying member 13 passed through the opening downstream end (upper end) 24. FIG. 18A illustrates how the conveying member 13 passes through the toner puddle D in Comparative Example. FIG. 18B illustrates a state after the conveying member 13 passed through the opening downstream end (upper end) 24.

As illustrated in FIG. 17A and FIG. 18A, the conveying member 13 passes through the toner puddle D. As illustrated in FIG. 17B and FIG. 18B, the toner is returned to the container 12.

In Comparative Example, the toner puddle D shown in FIG. 18A is larger than that of the third embodiment shown in FIG. 17A because of the difference in magnetic flux density at the S2 pole. In other words, the toner puddle D in the third embodiment is smaller than that in Comparative Example.

Next, endurance tests were performed on 5,000 sheets using the configuration of the third embodiment and the configuration of Comparative Example, and the density transitions of the solid black image were compared.

Figure 19:
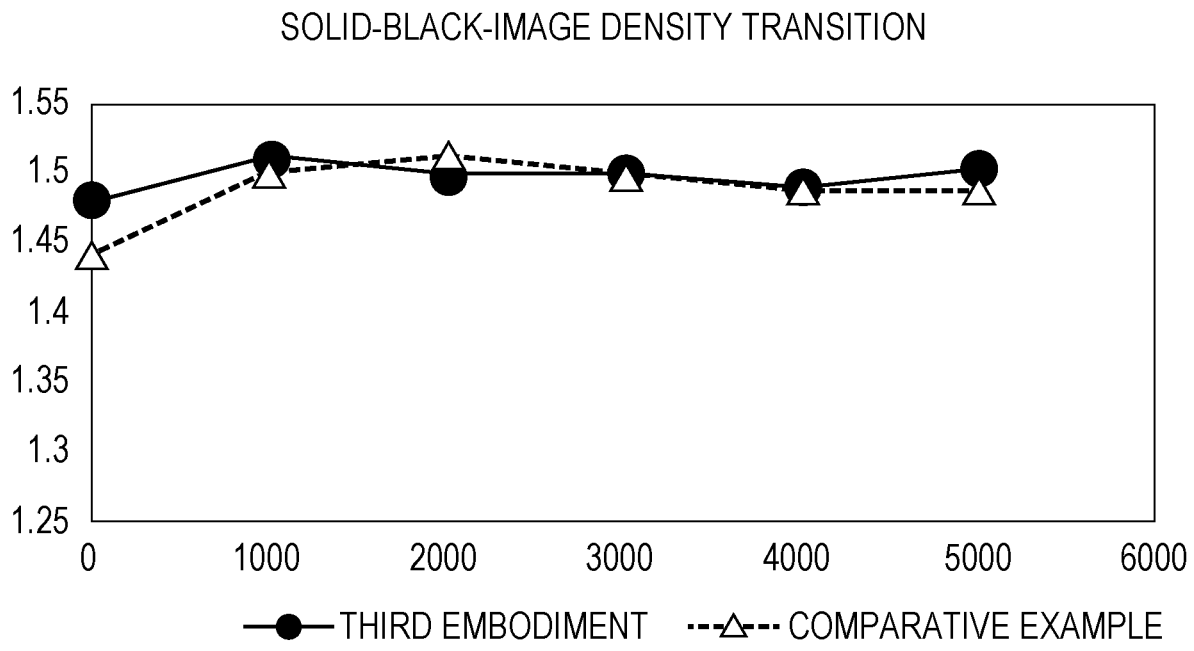
FIG. 19 is a graph showing the results of print tests with the configurations of the third embodiment of the present disclosure and Comparative Example.
Figure 20:
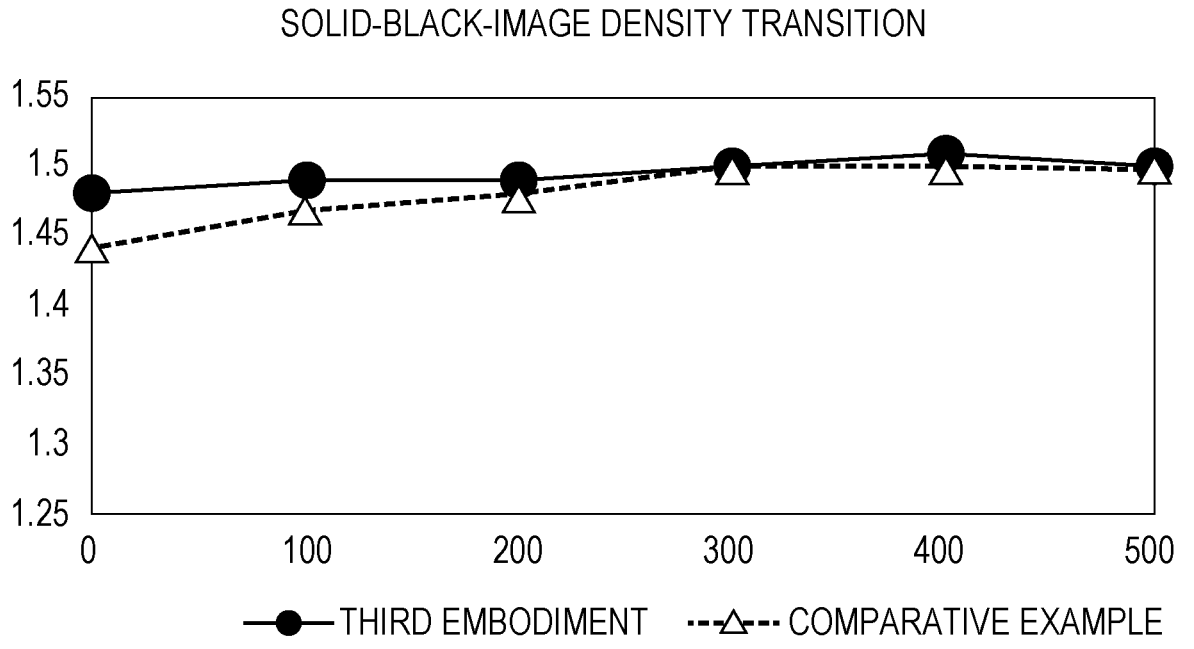
FIG. 20 is a graph showing the transition from the beginning to printing of 500 sheets of the results of print tests shown in FIG. 19.

FIG. 19 is a graph showing the results of print tests with the configurations of the third embodiment of the present disclosure and Comparative Example. FIG. 20 is a graph showing the transition from the beginning to printing of 500 sheets of the results of print tests shown in FIG. 19.

As will be understood from FIG. 19 and FIG. 20, after 2,000 or more sheets have been printed, the third embodiment and Comparative Example show substantially the same density transition (endurance stability).

In the viewpoint of the density at the beginning and an increase in density from the beginning, the third embodiment is advantageous over the Comparative Example.

Specifically, when the density was checked every 100 sheets from the beginning to 500 sheets in the third embodiment and the Comparative Example, the density at the beginning was higher, and the number of sheets printed (elapsed time) until the density becomes stable was smaller in the third embodiment than in the Comparative Example. This may be because "small circulation" occurred in the toner puddle D in the vicinity of the sleeve 15B. This accelerates the charging of the toner and improves the developing performance.

Thus, in the third embodiment, the toner puddle D in the vicinity of the sleeve 15B can be decreased by decreasing the magnetic flux density of the toner attracting pole in the developing chamber 14, and the charging can be further accelerated. The third embodiment also achieves high endurance stability as in the first and second embodiments.

Also for a compact apparatus, the toner puddle D can be controlled to a desired size by using the configuration of the third embodiment, resulting in speeding up the acceleration of charging.

The configuration of the present disclosure can be summarized as follows:

1. A developing unit 11 according to an embodiment of the present disclosure includes a developing frame 11A, a developer bearing member 15 supported by the developing frame and including a magnetic-field generating member 15A, the developer bearing member being configured to carry a developer having a magnetic property, a conveying member 13 supported by the developing frame and including a rotation shaft 20 and a sheet portion 21 of which a first end 21A is fixed to the rotation shaft and a second end 21B is a free end, the conveying member conveying the developer to the developer bearing member, and a partition 111 that partitions an inner space 11B of the developing frame into a developing chamber 14 in which the developer bearing member is housed and a developer chamber 12 in which the conveying member is housed, the partition including an opening 19 for communicating the developing chamber with the developer chamber.

The developing unit according to an embodiment of the present disclosure is configured such that, when the conveying member rotates, the free end of the sheet portion can enter the developing chamber through the opening, Relations C>A and B>A are satisfied, where A is a distance from a rotation center 25 of the rotation shaft 20 to an upstream end 23 of the opening in a rotational direction R3 of the rotation shaft, B is a distance from the rotation center to a downstream end 24 of the opening in the rotational direction, and C is a length from the rotation center to the free end of the sheet portion in an unbent state.

The upstream end of the opening is lower in a direction of gravitational force G than the downstream end at an orientation in use.

The configuration of the embodiment of the present disclosure allows the magnetic toner to be efficiently fed back from the developing chamber to the developer chamber to improve the mixing and circulation of the magnetic toner, achieving stable image formation over a long period.

In particular, this configuration is advantageous in reducing the size of the image forming apparatus and the developing unit and is adaptable to a small-diameter developing sleeve including (housing) a magnet roller as well as a magnet roller with a low magnetic flux density (magnetic force). In other words, this configuration exhibits the advantageous effects also for a configuration in which the movement of the developer in the vicinity of the developing sleeve along with the rotating operation of the developing sleeve is limited to an area closer to the surface of the developing sleeve. Thus, the configuration of the embodiment of the present disclosure reduces stagnation of the developer supplied from the developer chamber to the developing chamber, preventing a decrease in the electrostatic property of the developer. For this reason, the developing performance of the developer can easily be maintained in the latter half of the available period (life) of the developing unit.

2. In the developing unit according to the embodiment of the present disclosure, the partition 111 may have an attaching surface 112 for use in attaching a sealing member 22 configured to seal the opening and removable during use, and the opening 19 may be provided at the attaching surface.

Disposing the opening in the attaching surface makes it easier to provide (both) of "the opening" and "the sealing member attaching surface".

3. The developing unit according to the embodiment of the present disclosure may further include a regulating member 16 at the developing frame 11A, the regulating member regulating a thickness of the developer carried on the developer bearing member, wherein a regulating position P1 of the regulating member with respect to the developer bearing member may be higher than the upstream end 23 of the opening at the orientation in use.

This provides more stable regulation performance at the regulating position.

4. In the developing unit according to the embodiment of the present disclosure, the developer bearing member 15 may include a developing sleeve 15B that rotates, and the regulating member 16 may include a fixed end 161 fixed to the developing frame and a free end 162 extending upstream in a rotational direction of the developing sleeve and being in contact with a circumferential surface 15B1 of the developing sleeve.

5. In the developing unit according to the embodiment of the present disclosure, a straight line L1 connecting a rotation center 15C of the developing sleeve and the rotation center 25 of the rotation shaft 20 may pass through the opening 19 as viewed in an axial direction 25A of the rotation shaft.

6. In the developing unit according to the embodiment of the present disclosure, the rotation center 25 of the rotation shaft 20 may be located above the upstream end 23 of the opening and below a center 15C of the developer bearing member 15 as viewed in the axial direction 25A of the rotation shaft 20.

7. In the developing unit according to the embodiment of the present disclosure, the magnetic-field generating member 15A may include, in a cross section orthogonal to a longitudinal direction L2 of the developer bearing member 15, a first magnetic pole S1 disposed in a direction D1 facing an image bearing member 9 carrying a static latent image, a second magnetic pole N1 disposed in a direction D2 facing the regulating position P1, a third magnetic pole N2 disposed next to the first magnetic pole S1 and opposite to the second magnetic pole N1, and a fourth magnetic pole S2 disposed next to the second magnetic pole N1 and opposite to the first magnetic pole S1, and the conveying member 13 may be configured to pass through an area W1, in the vicinity of a surface of the developer bearing member 15, between the second magnetic pole N1 and the fourth magnetic pole S2 when the conveying member rotates.

This allows the distal end of the sheet to pass through an area in which the developer tends to accumulate due to the magnetism, enabling the toner to be effectively fed back (circulated) from the developing chamber to the developer chamber.

8. In the developing unit according to the embodiment of the present disclosure, the upstream end 23 of the opening may be disposed higher than a lowermost portion 121 of the developer chamber 12 at an orientation in use.

This prevents the toner from flowing back to the developing chamber when mixing the old and new toners in the developer chamber.

9. In the developing unit according to the embodiment of the present disclosure, the developing chamber 14 may include a first surface 141 connecting to the upstream end 23 of the opening, and the first surface 141 may decrease in height with a decreasing distance to the opening.

This allows the developer in the developing chamber to be returned to the developer chamber more effectively.

10. In the developing unit according to the embodiment of the present disclosure, the distance B and the length C may satisfy a relation B>C.

This allows the developer in the developing chamber to be returned to the developer chamber more efficiently, improving the mixing and circulation.

11. In the developing unit according to the embodiment of the present disclosure, the developer may be a single-component magnetic developer or a two-component developer.

12. In the developing unit according to the embodiment of the present disclosure, the developing unit may be configured to be attached to and detached from an image forming apparatus 1A.

13. A process cartridge 2 according to an embodiment of the present disclosure includes the developing unit 11 and an image bearing member 9 that carries an image.

14. An image forming apparatus 1A according to an embodiment of the present disclosure includes the developing unit 11 or the process cartridge 2 and a fixing member 6.

The configuration according to the embodiments of the present disclosure improves the circulation of the magnetic developer between the developing chamber and the developer chamber containing the developer.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-102032 filed Jun. 12, 2020, which is hereby incorporated by reference herein in its entirety.

What is claimed is:

1. A developing unit comprising:

a developing frame;

a developer bearing member supported by the developing frame and including a magnetic-field generating member, the developer bearing member being configured to carry a developer having a magnetic property;

a conveying member supported by the developing frame and including a rotation shaft and a sheet portion of which a first end is fixed to the rotation shaft and a second end is a free end, the conveying member conveying the developer to the developer bearing member; and a partition that partitions an inner space of the developing frame into a developing chamber in which the developer bearing member is disposed and a developer chamber in which the rotation shaft of the conveying member is disposed, the partition including an opening for communicating the developing chamber with the developer chamber, wherein, when the conveying member rotates, the free end of the sheet portion enters the developing chamber through the opening, wherein relations C >A and B >A are satisfied, where A is a distance from a rotation center of the rotation shaft to an upstream end of the opening in a rotational direction of the rotation shaft, B is a distance from the rotation center to a downstream end of the opening in the rotational direction, and C is a length from the rotation center to the free end of the sheet portion in an unbent state, and wherein the upstream end of the opening is lower in a direction of gravitational force than the downstream end of the opening at an orientation in use, and wherein the downstream end of the opening is lower in the direction of gravitational force than an upper end of the magnetic-field generating member at the orientation in use.

2. The developing unit according to claim 1, wherein the partition has an attaching surface for use in attaching a sealing member configured to seal the opening and removable during use, and wherein the opening is provided at the attaching surface.

3. The developing unit according to claim 1, wherein the upstream end of the opening is disposed higher than a lowermost portion of the developer chamber at an orientation in use.

4. The developing unit according to claim 1, wherein the developing chamber includes a first surface connecting to the upstream end of the opening, and wherein the first surface decreases in height with a decreasing distance to the opening.

5. The developing unit according to claim 1, wherein the distance B and the length C satisfy a relation B >C.

6. The developing unit according to claim 1, wherein the developer bearing member is further configured to carry a single-component magnetic developer.

7. The developing unit according to claim 1, wherein the developing unit is configured to be attached to and detached from an image forming apparatus.

8. An image forming apparatus comprising:

the developing unit according to claim 1; and a fixing member.

9. A process cartridge comprising:

the developing unit according to claim 1; and an image bearing member that carries an image.

10. An image forming apparatus comprising:

the process cartridge according to claim 9; and a fixing member.

11. The developing unit according to claim 1, further comprising:

a regulating member which regulates a thickness of the developer carried on the developer bearing member, wherein a regulating position of the regulating member with respect to the developer bearing member is higher than the upstream end of the opening at the orientation in use.

12. The developing unit according to claim 11, wherein the developer bearing member includes a developing sleeve that rotates, and wherein the regulating member includes a fixed end fixed to the developing frame and a free end extending upstream in a rotational direction of the developing sleeve and being in contact with a circumferential surface of the developing sleeve.

13. The developing unit according to claim 12, wherein, in a cross section orthogonal to a longitudinal direction of the developer bearing member, the magnetic-field generating member includes:

a first magnetic pole disposed at a position facing an image bearing member carrying a static latent image, the first magnetic pole having a magnetic pole in a direction toward the image bearing member;

a second magnetic pole disposed next to the first magnetic pole in a direction of the circumferential surface of the developing sleeve, the second magnetic pole having a magnetic pole in a direction toward the regulating position;

a third magnetic pole disposed next to the first magnetic pole in the direction of the circumferential surface of the developing sleeve, the third magnetic pole being disposed at a position opposite of a position where the second magnetic pole is disposed; and a fourth magnetic pole disposed next to the second magnetic pole in the direction of the circumferential surface of the developing sleeve, the fourth magnetic pole being disposed at a position opposite of a position where the first magnetic pole is disposed, and wherein the conveying member is configured to pass through an area, adjacent to a surface of the developer bearing member, between the second magnetic pole and the fourth magnetic pole when the conveying member rotates.

14. The developing unit according to claim 12, wherein a straight line connecting a rotation center of the developing sleeve and the rotation center of the rotation shaft passes through the opening as viewed in an axial direction of the rotation shaft.

15. The developing unit according to claim 14, wherein the rotation center of the rotation shaft is located above the upstream end of the opening and below a center of the developer bearing member as viewed in the axial direction of the rotation shaft.

* * * * *